US007170416B2

(12) United States Patent
Philippe et al.

(10) Patent No.: US 7,170,416 B2
(45) Date of Patent: Jan. 30, 2007

(54) DEVICE FOR DETECTING A BODY FALLING INTO A SWIMMING POOL

(75) Inventors: Francois Philippe, Juan les Pins (FR); Philippe Montaron, Champigny sur Marne (FR)

(73) Assignee: F and F International SARL, Ben Arous (TN)

( * ) Notice: Subject to any disclaimer, the term of this patent is extended or adjusted under 35 U.S.C. 154(b) by 127 days.

(21) Appl. No.: 10/522,409

(22) PCT Filed: Jul. 25, 2003

(86) PCT No.: PCT/FR03/02369

§ 371 (c)(1),
(2), (4) Date: Mar. 25, 2005

(87) PCT Pub. No.: WO2004/011949

PCT Pub. Date: Feb. 5, 2004

(65) Prior Publication Data

US 2005/0258968 A1 Nov. 24, 2005

(30) Foreign Application Priority Data

Jul. 26, 2002 (FR) ..... 02/09491

(51) Int. Cl.
*G08B 23/00* (2006.01)

(52) U.S. Cl. ..... 340/573.6; 340/573.1; 340/511; 340/544; 116/4

(58) Field of Classification Search ..... 340/573.6, 340/511, 573.3, 553, 614, 611, 522, 566, 340/552, 541, 544; 116/4, 5, 6, 86
See application file for complete search history.

(56) References Cited

U.S. PATENT DOCUMENTS

| | | | | |
|---|---|---|---|---|
| 5,638,048 | A * | 6/1997 | Curry | 340/552 |
| 5,828,304 | A * | 10/1998 | Mowday | 340/566 |
| 5,903,218 | A * | 5/1999 | Nelson | 340/573.6 |
| 5,959,534 | A * | 9/1999 | Campbell et al. | 340/573.6 |
| 2003/0156031 | A1 | 8/2003 | Philippe | 340/565 |

FOREIGN PATENT DOCUMENTS

| | | |
|---|---|---|
| FR | 2 763 684 | 11/1998 |
| WO | WO 01/88870 | 11/2001 |

* cited by examiner

*Primary Examiner*—Anh V. La
(74) *Attorney, Agent, or Firm*—James C. Lydon

(57) ABSTRACT

Device to deliver an alarm signal upon detection of a gravitational wave generated by a body falling into a swimming pool, using a differential detector that includes a comparison device for comparing a sensitivity threshold value to the value of the electrical signal received, and to deliver an alarm signal when the received electrical signal exceeds the sensitivity threshold value. The electrical signal resulting from the detected waves is delivered to a comparator and allows a programmed microprocessor to deliver variable-width pulses to the input of the comparator so as to reduce the sensitivity of the device when the device detects an atmospheric disturbance. The microprocessor triggers the alarm when the width of the output pulses from the comparator is larger than a predetermined critical reference and when the frequency F of the analogue electrical signal lies between two predetermined values F1 and F2.

12 Claims, 6 Drawing Sheets

DEVICE FOR DETECTING A BODY FALLING INTO A SWIMMING POOL

TECHNICAL FIELD

The present invention relates to the detection of shock waves in the aquatic medium and relates in particular to a device for detecting a body, such as that of a child, falling into a swimming pool.

PRIOR ART

Many villas now have a swimming pool, mainly in southern regions. These swimming pools are generally not surrounded by safety barriers. There is therefore a high risk of an unsupervised young child walking close to the edge falling into the water and drowning. Child deaths by falling into a pool currently represent one quarter of the infant mortality caused by accidents.

It has therefore been conceived to install detectors that detect aquatic waves on the surface of the water in swimming pools. Such a detector is actuated when the pool is not attentively supervised, in order to be able to raise the alarm in the event of a child unluckily falling into the pool. Unfortunately, the multiplicity of causes that result in waves on the surface of the water, which would make this type of apparatus react, makes their use uncertain or even ineffectual owing to spurious elements that cannot be easily controlled, especially disturbances due to bad weather (wind or rain) that cause the alarm to be inopportunely triggered.

A device for detecting a body falling into a pool, especially that of a young child, has been described in patent application No. 2,763,684. Such a device comprises a means of converting the aquatic waves picked up by a sensing means into an electrical signal and a differential detector that includes a comparison means for comparing the value of a sensitivity threshold to the value of the electrical signal and to deliver an alarm signal when the electrical signal results from the conversion of a gravitational wave generated by a body falling into the pool.

The differential detector used in such a device includes a sensitivity threshold permanently set to its optimum value by the electrical signal generated by the sensing means, which depends on the disturbances created on the surface of the pool by atmospheric disturbances, such as those induced by bad weather or a disturbance brought about by the regeneration of the water in the pool.

Such a differential detector is disclosed in patent application PCT WO 01/088870. It includes autoregulation means consisting mainly of an analogue/digital converter, the input of which is connected to the output of an amplifier, the input of which is connected to the output of the sensing of the aquatic waves in order to deliver, as output, a digital signal according to the disturbance. A programmed microprocessor delivers, in response to the detection of the digital signal delivered by the converter, a digital signal to the "−" input of the comparator, the pulses of which have a variable width that increases with the duration and with the magnitude of the disturbance so as to automatically increase the trigger threshold of the alarm device and therefore to reduce its sensitivity when the acoustic sensor detects an atmospheric disturbance, such as wind, or a disturbance due to the system for regenerating the water in the pool.

Such a device operates perfectly well when the disturbance detected at the input reaches its optimum phase in a steady manner. Unfortunately, when the pool filtration system is switched on (most of the time suddenly), or when the atmospheric disturbance occurs suddenly, the device does not have time to increase its sensitivity threshold before the alarm system is inopportunely triggered.

Furthermore, a device for detecting a child falling into a swimming pool must be entirely reliable, that is to say it must detect this fall with certainty. It is therefore necessary for such a device to recognize, unequivocally, that is to say with 100% reliability, the "signature" caused by a child falling into the pool.

SUMMARY OF THE INVENTION

It is for this reason that the object of the invention is to provide a device for detecting a child falling into a swimming pool that can recognize this fall unequivocally while continually carrying out its autoregulation function so as to avoid any inopportune triggering.

The subject of the invention is therefore a device intended to deliver an alarm signal upon detection of a gravitational wave generated by a body falling into a swimming pool, which comprises a means of sensing aquatic waves that is placed beneath the surface of the water of the swimming pool, a means of converting the aquatic waves sensed by the sensing means into an analogue electrical signal, and a differential detector that includes comparison means for comparing the sensitivity threshold value of the differential detector with the value of the analogue electrical signal and to deliver the alarm signal when the analogue electrical signal exceeds the sensitivity threshold value. The differential detector comprises autoregulation means consisting mainly of an analogue/digital converter that receives the preamplified analogue electrical signal as input and delivers a digital signal as output when a disturbance in the water occurs, a comparator, the "+" input of which receives the preamplified analogue electrical signal, and a microprocessor programmed to deliver, in response to the detection of the digital signal delivered by the converter, a digital signal to the "−" input of the comparator, the output pulses of which have a variable width, which increases with the duration and with the magnitude of the disturbance so as to automatically increase the threshold for tripping an alarm means and therefore to reduce the sensitivity of the device when the sensing means detects an atmospheric disturbance, such as wind. The device is characterized in that the microprocessor triggers the alarm means when the width of the output pulses from the comparator is larger than a predetermined critical reference and that the frequency F of the analogue electrical signal lies between two predetermined values F1 and F2.

BRIEF DESCRIPTION OF THE FIGURES

The aims, objects and features of the invention will become more clearly apparent on reading the description that follows, with reference to the drawings in which.

DETAILED DESCRIPTION OF THE INVENTION

Figure 1:
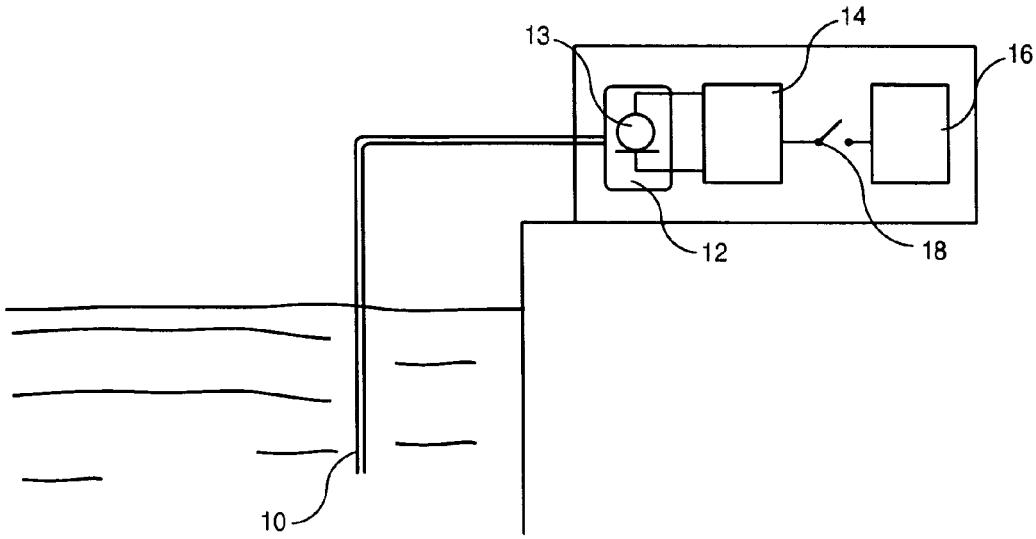
FIG. 1 is a schematic of a device according to the invention for detecting a body falling into a swimming pool.

According to a preferred embodiment of the invention illustrated in FIG. 1, the device comprises a right-angled tube 10, the vertical portion of which is immersed in the water so that the inlet of the tube is a few centimeters below the surface of the water in the pool. The tube is connected at its external end to a chamber 12 in which there is a microphone 13 connected to a differential detector 14. The latter is connected to an alarm means 16, such as a buzzer or a siren, or any other indicating device, via a switch 18 for disconnecting the alarm means when the pool is supervised.

The water level inside the tube 10 is normally stable. However, any change in this level causes a variation in the pressure of the air in the tube and in the chamber 12, and thus gives rise to the emission of acoustic waves that are converted by the microphone 13 into an electrical signal.

The gravitational wave generated by a body (such as that of a young child) falling into the water in the pool essentially propagates below the surface of the water. Even though it is visually barely perceptible on the surface, it causes a sudden variation in the level inside the submerged tube owing to the upward vertical thrust. A sudden variation in this level by a few millimeters is therefore interpreted by the differential detector as a signal that triggers the alarm.

However, any turbulence created on the surface by the weather and the horizontal current brought about by the regeneration of the water cause variations in the level inside the submerged tube. These variations are sensed by the differential detector, but their low amplitude actuates the autoregulation mechanism, which prevents the alarm from being inopportunely triggered.

In the embodiment illustrated in FIG. 1, the part out of the water is preferably a sealed plastic case containing a battery for supplying the detector, it being possible for this battery to be kept charged by a solar sensor serving as cover for the case.

Figure 2:
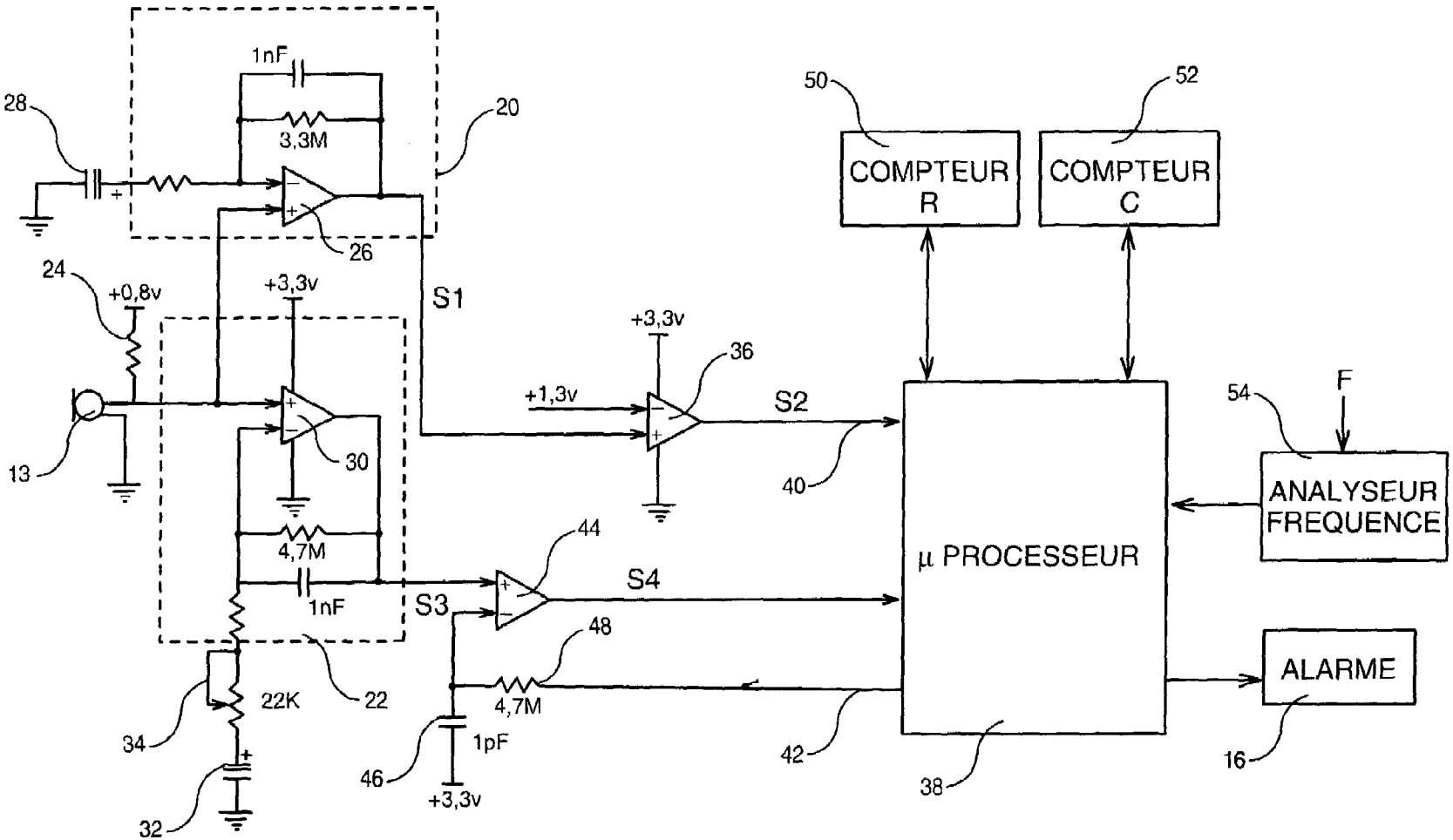
FIG. 2 is a block diagram of a device according to the invention, showing all the components of the differential detector.

Apart from the microphone 13 responsible for picking up the acoustic signals and the alarm means 16, the device according to the invention mainly consists of the differential detector that is illustrated in FIG. 2.

The signals coming from the microphone 13 are transmitted, on the one hand, to the "+" input of a constant-gain amplifying means 20 and, on the other hand, to the "+" input of a variable-gain amplifying means 22 via a resistor 24 connected to a voltage of 0.8 volts.

The amplifying means 20 is mainly composed of an operational amplifier 26 that has, between its "−" input and its output, a resistor (with a value of 3.3 MΩ) and a capacitor (with a value of 1 nF) serving as feedback for limiting the gain. The "−" input is grounded via an electrolytic capacitor 28 preventing the quiescent voltage from being amplified.

The amplifying means 22 is mainly composed of an operational amplifier 30 that has, between its "−" input and its output, a resistor (with a value of 4.7 MΩ) and a capacitor (with a value of 1 nF) serving as feedback for limiting the gain. The "−" input is grounded via an electrolytic capacitor 32, which prevents the quiescent voltage from being amplified, and via a 210 to 10 000 potentiometer 34, which is adjusted according to the room in which the alarm device is installed, the necessary gain of the amplifying means being lower the more soundproof said room is.

The output (signal 51) from the amplifying means 20 is sent to the "+" input of a comparator 36, the function of which is to convert the analogue signal delivered by the amplifying means 20 into a binary signal, the width of which depends on the magnitude of the disturbance, said binary signal being transmitted to the microprocessor 38 for the purpose of autoregulating the alarm device.

In fact, when an atmospheric disturbance, such as wind, occurs, this disturbance generates a modulated signal at the output of the amplifying means 20, such a signal generally having a low frequency of between 10 and 20 Hz. This signal, delivered to the "1" input of the comparator 36, results in a digital output signal (signal S2) at the output 40 of said comparator and therefore at the input of the microprocessor 38. The latter, which detects a value 1 at the output 40 of the comparator 36, then transmits, after a given delay, digital pulses on the output line 42, the purpose of which is to reduce the sensitivity of the device so as not to trigger the alarm inopportunely in the event of the wind blowing, as will be seen below.

The output of the amplifying means 22 is connected to the "+" input of a comparator 44, which converts the analogue signal delivered by the amplifying means 22 into a binary signal (signal S4) that is transmitted to the microprocessor 38. When a signal corresponding to a child falling into the pool is recognized by the microprocessor 38, the latter transmits a signal to the alarm means 16, which could be a radio transmitter transmitting the alarm signal to an alarm room.

As was seen above, the microprocessor 38 is programmed to transmit a signal on its output 42 when it detects, on its input 40, a digital signal of value 1 coming from the comparator 36. This signal is formed from negative pulses of variable width depending on the number and on the width of the pulses of value 1 that are detected on the input 40. Consequently, assuming that this input is sampled at a frequency of 150 Hz, an input bit with a frequency of 15 Hz will therefore be sampled about 5 times if the received signal is a perfect sinusoid. At each sampling, the width of the pulse transmitted on the line 42 will be increased. Likewise, this width is reduced each time that the microprocessor detects the value 0 of the signal on the line 40. It may therefore be seen that the stronger the wind, the wider the transmitted pulses output by the comparator 36 and also the wider the negative pulses delivered on the line 42. Pulse width modulation is thus obtained.

The negative pulses transmitted on the line 42 charge up, via the resistor 48 (having a value of 4.7 MΩ), the capacitor 46 (having a value of 1 μF) to a greater or lesser extent, thereby delivering a voltage whose value depends on the width of the pulses delivered on the line 42. The wider these pulses, the less the capacitor 46 is charged, and the higher the voltage signal (S3) delivered on the "−" input of the comparator 44, the lower the sensitivity of the comparator 44 reacting to the signal received from the sensor 13 in order to trigger the alarm 16. It should be noted that the time during which the microprocessor 38 is reacting to the presence of the atmospheric disturbance, by transmitting negative pulses of greater and greater width to the integrator 46–48, may be limited to a maximum value such as 10 or 20 s.

With the autoregulation of the sensitivity threshold that has just be described, it may therefore be seen that if the wind changes to a storm, the alarm is not triggered owing to the fact that the sensitivity threshold of the comparator 34 has been automatically increased beforehand.

As will be seen in the rest of the description, the device includes a time counter R 50 used by the microprocessor during the autoregulation process and a time counter C 52 used by the microprocessor during a phase in which the device is periodically autocalibrated. Furthermore, there is also an analyzer 54, that analyzes the frequency F of the signal received by the device and used by the microprocessor to trigger the alarm.

Figure 3:
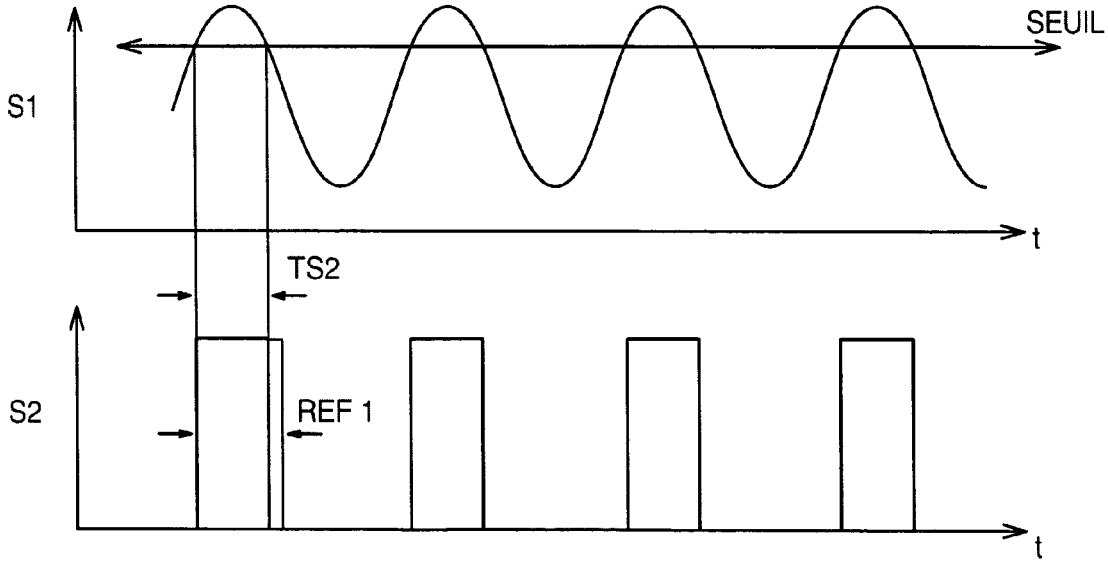
FIG. 3 represents a time plots of the input and output signals of the first comparator used in the device according to the invention.

Assuming that the signal S1 transmitted by the amplifier 26 is the sinusoidal signal as shown in the first plot in FIG. 3, the input of the amplifier 36 acts as a threshold for obtaining a pulse S2 of width TS2, illustrated on the second plot in FIG. 3. As will be seen, this pulse is taken into account by the microprocessor 38 only if its width exceeds a first minimum reference REF1 so as to reduce the maximum sensitivity, this being done so as to prevent the device from being triggered without any reason, due to errors associated with the manufacturing constraints and with thermal variations.

Figure 4:
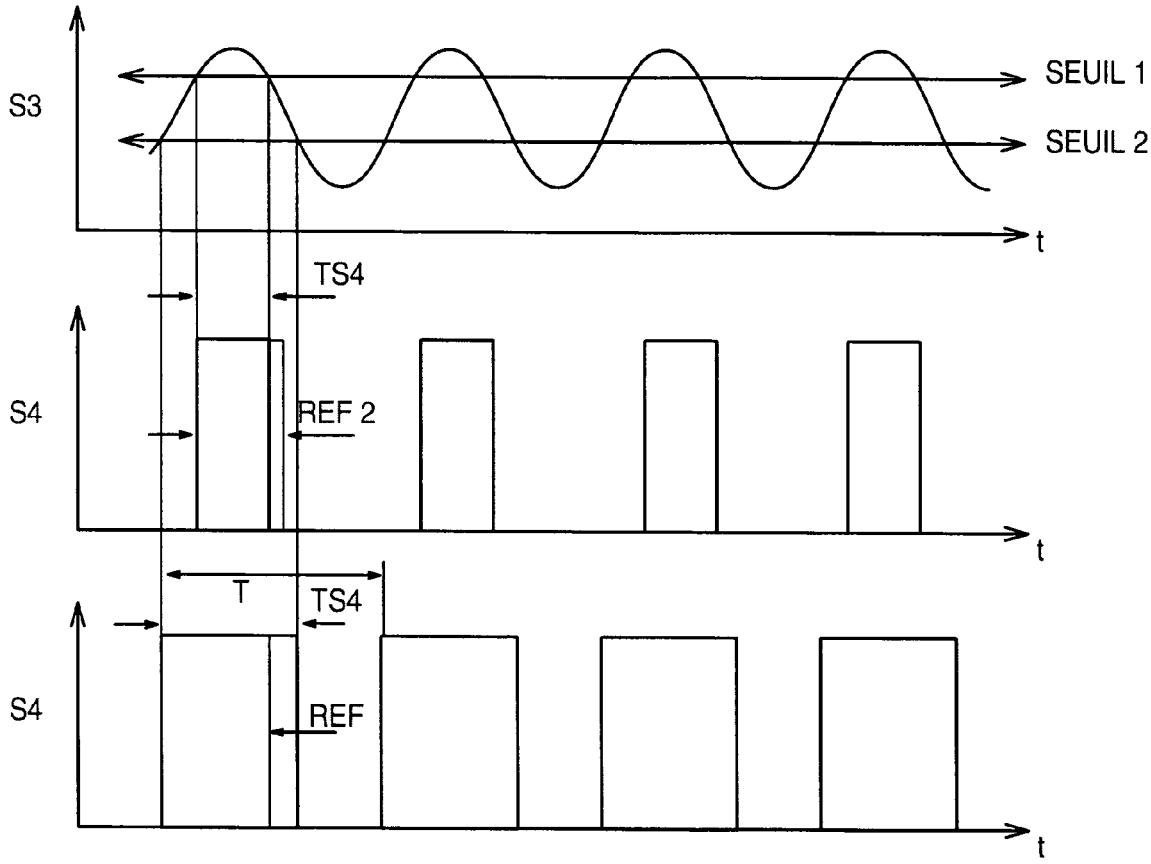
FIG. 4 represents a time plots of the input and output signals of the second comparator used in the device according to the invention.

Assuming that the signal output by the amplifier 30 is the sinusoidal signal shown on the first plot in FIG. 4, it is subjected to two thresholds corresponding to two values of the signal S3 at the terminal of the capacitor 32, which signal values make it possible to obtain the pulses illustrated on the second and the third plots in FIG. 4, respectively. The first threshold is a threshold for obtaining a value REF3 below which the pulse width TS4 obtained at the output of the comparator 44 is ignored. The second threshold is used to obtain a pulse width reference REF above which an analysis of the frequency 1/T of the waves received by the device is carried out and the alarm is triggered if this frequency lies between two predetermined values, as will be seen later.

Figures 5, 6:
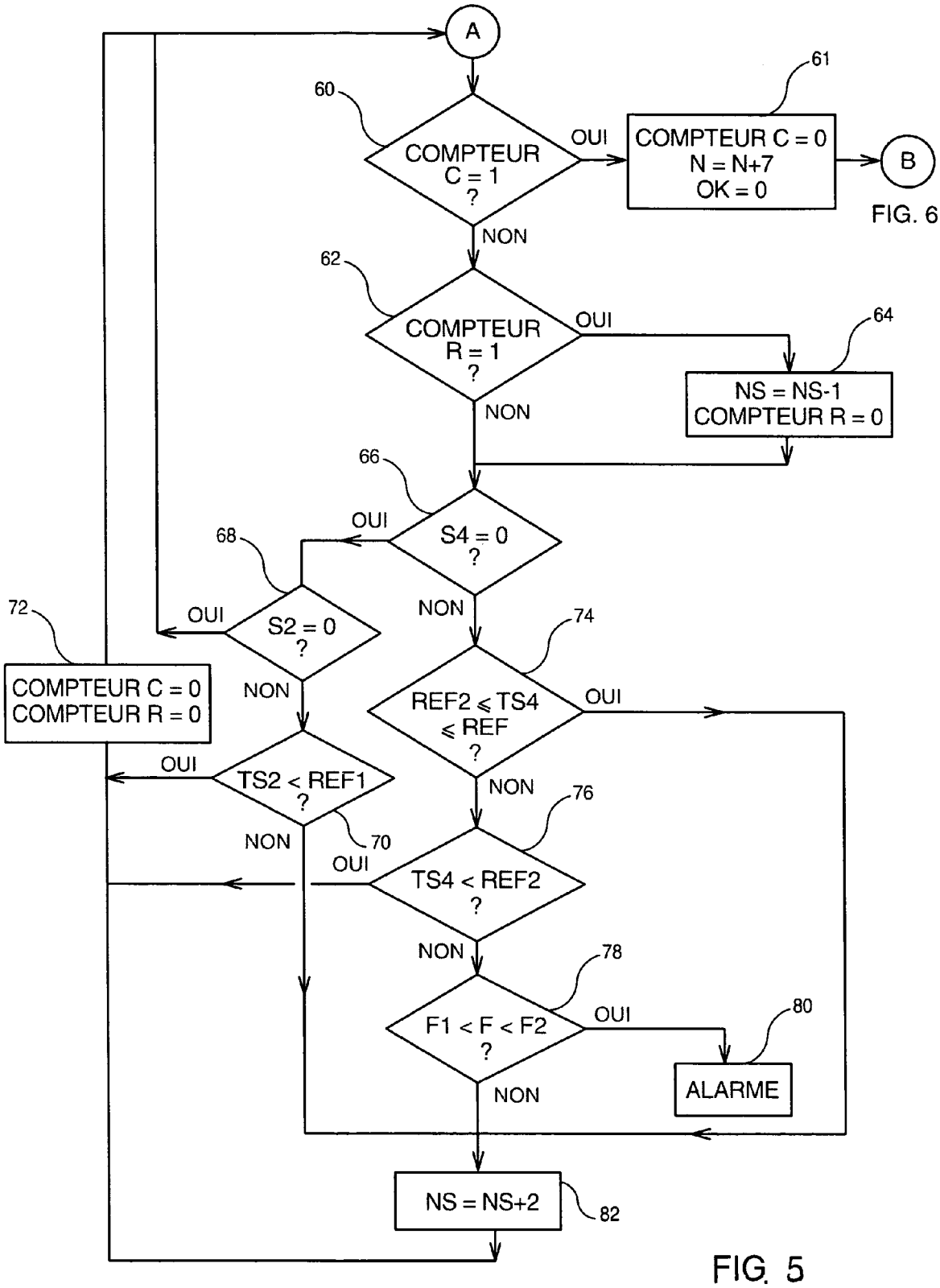
FIG. 5 is a flowchart or the autoregulation procedure used in the device according to the invention.
FIG. 6 is a flowchart for the autocalibration phase used in the device according to the invention.
Figure 6:
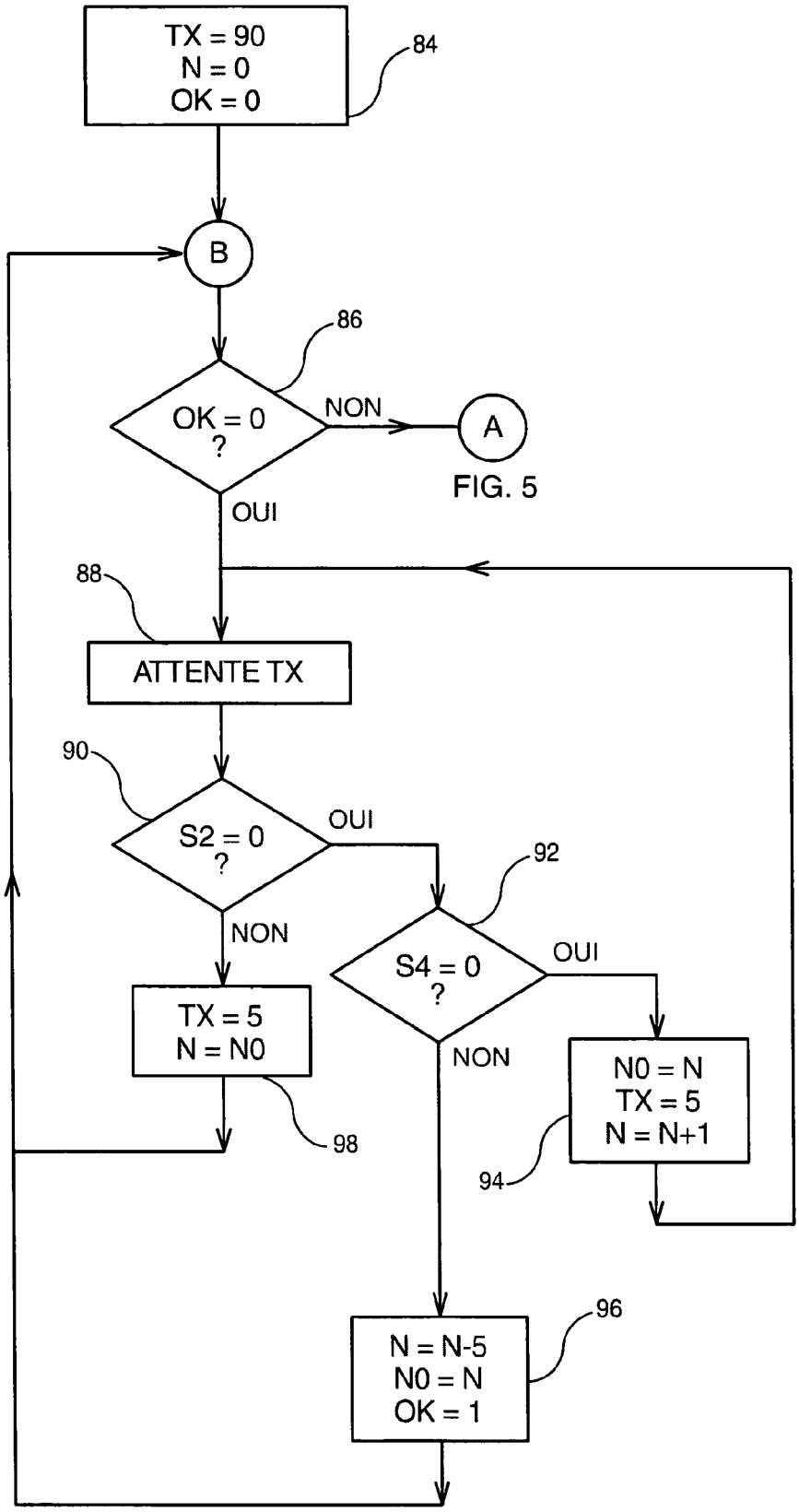

The autoregulation procedure according to the invention is illustrated in FIG. 5. Firstly, at the start of the procedure, the microprocessor checks whether the counter C has completed its decrementation down to 0 (or its incrementation up to a maximum value), in which case its logic value is equal to 1 (step 60). If this is the case, the autocalibration phase (B) is initiated after the resetting of the counter C (that is to say the counter resumes decrementing or incrementing), the incrementation of a variable N to N+7, N being the time during which the capacitor 46 is being charged by the microprocessor, and the resetting of a variable OK, which will be set to 1 when the autocalibration will have taken place (step 61). Otherwise, the microprocessor checks whether the counter R has completed is decrementation down to 0 (or its incrementation up to a maximum value), in which case its logic value is 1 (step 62).

If the counter R has already reached its optimum value (its logic value is 1), a variable NS defining the sensitivity level of the device is decremented by 1 and the counter R is again actuated (it logic value is 0) (step 64). The decrementation by 1 corresponds to an increase in the sensitivity of the device. It should be noted that the sensitivity level NS could vary from the value 0 (maximum sensitivity) to 40 (minimum sensitivity). It should also be noted that a decrementation of NS corresponds to a lowering of the threshold 1 of the signal S4 (see FIG. 4).

Whether or not the variable NS has been decremented after the verification of the counter R by the microprocessor, the latter determines if the signal S4 is equal to 0 (step 66). If this is the case, the microprocessor determines whether the signal S2 is also equal to 0 (step 66). If this is the case, the procedure is looped back to its starting point, without resetting the counter R.

If the value of S2 is not equal to 0, the microprocessor determines whether the width TS2 of the pulse S2 (see FIG. 3) is below REF1 (step 70). If this is the case, the procedure is looped back to its starting point, after the counters R and C have been reset (step 72).

When the value of S4 is equal to zero, the microprocessor determines whether the width TS4 of the pulse S4 is between the reference values REF2 and REF (step 74). If this is not the case, the microprocessor checks whether the value TS4 is below the lower reference REF2 (step 76) below which the disturbance signal in question is not considered as being significant. If this is the case, no action is undertaken and the procedure is looped back to its starting point after the counters R and C have been reset (step 72).

When the value of TS4 is not below REF2, that is to say when it is above REF, this means that the signal received by the device may be caused by a body falling into the water, as explained below. The microprocessor then checks whether the frequency F of the received signal lies between two limit values F1 and F2 (step 78). If so, this means that the signal results from a child's body falling into the pool, as explained below, and the alarm is triggered (step 80).

When S4 is equal to zero and TS2 is greater than REF1, or S4 is equal to zero and TS4 is between REF2 and REF, or S3 is equal to zero and TS4 is greater than REF, while the frequency of the received signals does not lie between the two predetermined values F1 and F2, the sensitivity value NS is incremented by 2 (step 82). Such an incrementation allows the sensitivity threshold to be raised, although it could be reduced by one unit when the counter R has already reached 0 or its maximum capacitance (step 64). After this incrementation, the procedure is looped back to its starting point after the counters R and C have been reset (step 72). The purpose of resetting the counter R after each incrementation of NS is to avoid increasing the sensitivity of the device too rapidly.

As has just been seen, the triggering of the alarm is subordinated to the detection of a specified frequency of the aquatic waves received by the detector, the determination of this frequency constituting an essential feature of the invention. This is because it has been found that the speed of propagation of the aquatic waves over the surface of the water, and therefore their frequency, depends on the volume of water displaced and therefore on the volume and the weight of the body falling into the water, and also on the height of the fall. Insofar as, for a child, this height is approximately constant, i.e. 10 to 20 cm relative to the surface of the water, this height will not be taken into consideration.

In fact, it has been found that, for a given height of fall, the frequency of the aquatic waves depends directly on the ratio between the weight and the volume of the body that has fallen in, that is to say on its density.

Thus, a stone, with a density of 3, falling in produces aquatic waves with a frequency of about 0.6 Hz, whereas a ball, with a density of 0.3, falling in produces waves with a frequency of about 2 Hz. In the case of a child, having a density in the region of 1, the frequency of the aquatic waves is between 0.8 Hz and 1.2 Hz depending on the distance between the point of impact and the detector.

Figure 7:
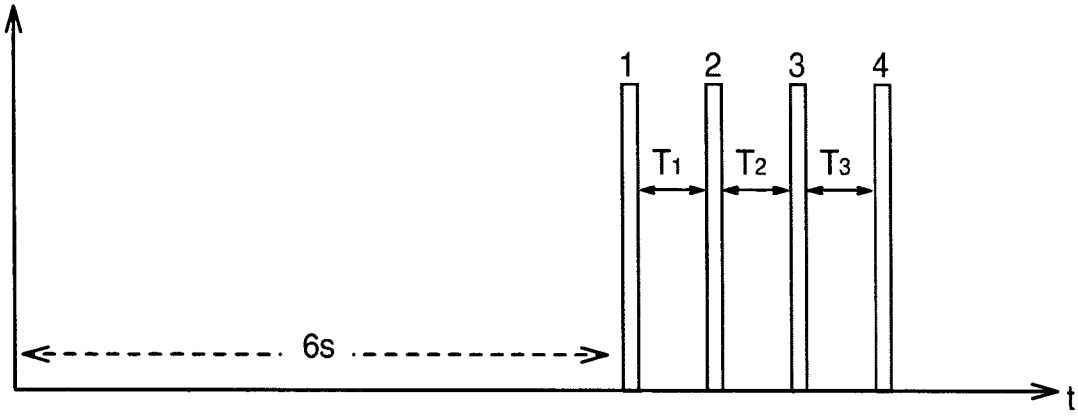
FIG. 7 shows the time plot of the amplitude of the aquatic waves caused by a child falling into a pool.

If we consider a distance of 5 m between the point of fall by the child and the detector, the train of aquatic waves (in general 4 waves) received by the detector is shown in the plot in FIG. 7. It may be seen that the first wave (or aquatic wave) reaches the detector after about 6 s and that the three other waves of the wave train arrive at decreasing intervals $T_1$, $T_2$ and $T_3$, the mean being about 1.12 s, i.e. a mean frequency of about 0.9 Hz.

Figure 8:
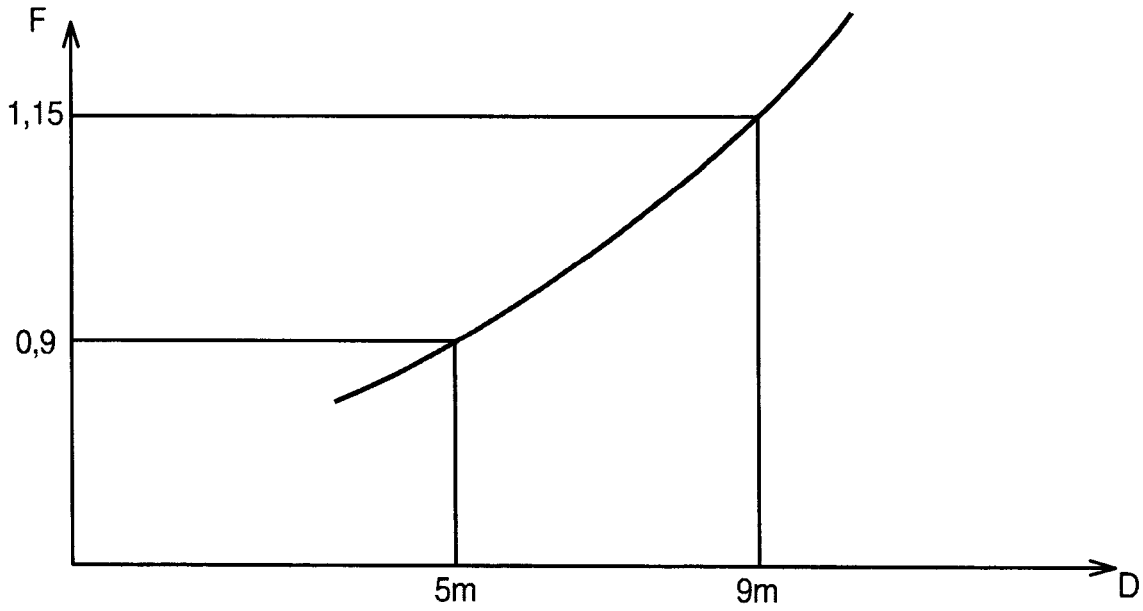
FIG. 8 shows the plot of the frequency of the aquatic waves caused by a child falling into a pool as a function of the distance between the impact and the detector.

The frequency of the waves detected by the detector depends in fact on the distance, as shown by the plot in FIG. 8. The greater this distance, the higher the frequency of the waves. Thus, if the distance goes from 5 m to 9 m, the frequency of the aquatic waves goes from about 0.9 Hz to about 1.15 Hz along a logarithmic-type curve. It should be noted that this distance must not be too great, insofar as the greater this distance, the longer the delay in detecting the fall. As a general rule, the detection delay could not exceed 10 s.

As was mentioned, the counter C is reset after each incident, that is to say when S2 and/or S4 is not equal to zero. However, if no incident is detected over a specified time, for example 15 minutes, the microprocessor assumes autocalibration, since the value of the counter C is equal to 1 (see step 60). Before the actual phase of autocalibrating the device illustrated in FIG. 6, the microprocessor will have carried out the "guard dog" test (not shown) and the initialization is carried out, if it is the first time there is autocalibration. This initialization consists in setting a variable TX to 90, which represents the time in seconds after which the autocalibration can be carried out, in setting the variable N to zero, N representing the time over which the capacitor 46 is charged by the microprocessor, and in setting the logic variable OK to zero, which variable will be reset to 1 when the autocalibration has taken place (step 84).

During the entire autocalibration phase, the first step consists in checking whether the variable OK is equal to zero (step 86). If this is not the case, the program returns to the main autoregulation procedure A (see FIG. 5). If the variable OK is equal to 0, the microprocessor waits until the time TX has elapsed before continuing its execution (step 88). At the end of the time TX, it determines whether the value of S2 is equal to 0 (step 90). If this is the case, it determines whether the value of S4 is equal to 0 (step 92). If this is also the case, the value of N is assigned a constant $N_0$ that indicates the reference time for charging the capacitor 46, allowing the maximum threshold to be obtained at the "−" input of the comparator 44, the time TX is set to 5 s, and the variable N is incremented by 1 (step 94). The program is then looped back to the TX waiting step (step 88). It may therefore be seen that the capacitor charging time N is incremented every 5 s and therefore the sensitivity threshold is lowered, as no incident has occurred.

As soon as the value of S4 reaches 1 (the input S3 becomes less than the "+" input of the comparator), meaning that the limit value has been reached, the microprocessor decrements the charging time N by 5 s so that the "−" input is substantially lower than the "+" input, the constant $N_0$ is set to N, which thus becomes the new reference value, and the variable OK is set to 1, in order to indicate that the autocalibration phase has been completed (step 96). The program is then looped back to its starting point.

When the microprocessor determines that the value of S2 is not equal to 0, meaning that there has probably been a disturbance, the waiting time TX is reset to 5 s and the variable N is set to the reference value $N_0$ (step 98). The program is then looped back to its starting point.

The invention claimed is:

1. A device intended to deliver an alarm signal upon detection of a gravitational wave generated by a body falling into a swimming pool, which comprises a means of sensing aquatic waves that is placed beneath the surface of the water of the swimming pool, a means of converting the aquatic waves sensed by said sensing means into an analogue electrical signal (S1), and a differential detector that includes comparison means for comparing a sensitivity threshold value of said differential detector with the value of said analogue electrical signal and to deliver said alarm signal when said analogue electrical signal exceeds said sensitivity threshold value, said differential detector comprising autoregulation means which includes an analogue/digital converter that receives a preamplified analogue electrical signal as input and delivers a digital signal (S2) as output when a disturbance in the water occurs, a comparator, the positive (+) input of which receives said preamplified analogue electrical signal, and a microprocessor programmed to deliver, in response to the detection of said digital signal delivered by said converter, a digital signal (S3) to the negative (−) input of said comparator, the output pulses (S4) of which have a variable width, which increases with the duration and with the magnitude of said disturbance so as to automatically increase the threshold for tripping an alarm means and therefore to reduce the sensitivity of the device when said sensing means detects an atmospheric disturbance;

wherein said device microprocessor triggers said alarm means when the width (TS4) of the output pulses (S4) from said comparator is larger than a predetermined critical reference (REF) and wherein the frequency F of said analogue electrical signal lies between two predetermined values F1 and F2.

2. The device of claim 1, in which said microprocessor assigns a sensitivity level (NS) to the device, said sensitivity level being incremented by 2 when the frequency F of said analogue electrical signal does not lie between said predetermined values F1 and F2 when the width (TS4) of the output pulses (S4) from said comparator is larger than said predetermined critical reference (REF).

3. The device of claim 2, in which said sensitivity level is incremented by 2 by said microprocessor when the width (TS4) of the output pulses (S4) from said comparator lies between a second predetermined minimum reference (REF2) and said predetermined critical reference (REF).

4. The device of claim 2, in which said sensitivity level is incremented by 2 by said microprocessor when the value of the output pulses (S4) from said comparator is equal to 0, while the value of the digital signal (S2) output by said analogue/digital converter is not equal to 0 and when the width (TS2) of said digital signal is smaller than a first predetermined minimum reference (REF1).

5. The device of claim 4, in which said differential detector furthermore includes an auto regulation counter that is actuated in order to decrement from a predetermined capacitance down to 0 or to increment from 0 up to said predetermined capacitance when, with the value of the output pulses (S4) from said comparator being equal to 0, the value of the digital signal output by said analogue/digital converter is not equal to 0 and its width (TS2) is smaller than said first minimum reference (REF1).

6. The device of claim 3, in which said differential detector furthermore includes an autoregulation counter that is actuated by said microprocessor in order to decrement from a predetermined capacitance down to 0 or increment said predetermined capacitance from 0 (counter=0) when, the value of the output pulses (S4) from said comparator being different from 0, their width (TS4) is smaller than said second predetermined minimum reference (REF2).

7. The device of claim 5, in which said counter is not actuated for decrementing or incrementing (counter=0)

when the value of the output pulses (S4) from said comparator is equal to 0 and the value of the digital signal (S2) output by said analogue/digital converter is equal to 0.

8. The device of claim 7, in which, when it turns out that said autoregulation counter has finished decrementing or incrementing (counter=1), said sensitivity level (NS) is decremented by 1 by said microprocessor and said counter is again actuated for decrementing or incrementing (counter=0).

9. The device of claim 1, further comprising an autocalibration counter that is actuated by said microprocessor in order to decrement from a specified capacitance down to 0 or to increment from 0 up to said capacitance (counter=0), an autocalibration of the device being carried out when said counter has finished decrementing or incrementing (counter=1).

10. The device of claim 9, in which the value of said signal (S3) delivered to the negative (–) input of said comparator results from the charging of a capacitor by pulses delivered by said microprocessor during a time interval N, the autocalibration consisting in incrementing the value of N by 1 over a specified period as long as the values of the digital signal (S2) output by said analogue/digital converter and of the output pulses (S4) from said comparator are equal to 0.

11. The device of claim 10, in which the value of N is decremented by 5 when the value of the digital signal (S2) output by said analogue/digital converter is equal to 0 while the value of the output pulses (S4) from said comparator is different from 0.

12. The device of claim 1, wherein said predetermined frequencies F1 and F2 are equal to 0.8 Hz and 1.2 Hz respectively.

* * * * *